US012662954B2

(12) United States Patent
Nakamura

(10) Patent No.: US 12,662,954 B2
(45) Date of Patent: Jun. 23, 2026

(54) INTERNAL COMBUSTION ENGINE CONTROL DEVICE

(71) Applicant: TOYOTA JIDOSHA KABUSHIKI KAISHA, Toyota (JP)

(72) Inventor: Satoshi Nakamura, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 19/198,400

(22) Filed: May 5, 2025

(65) Prior Publication Data

US 2026/0092546 A1 Apr. 2, 2026

(30) Foreign Application Priority Data

Sep. 30, 2024 (JP) ..... 2024-170298

(51) Int. Cl.
*F01N 3/025* (2006.01)
*F01N 3/023* (2006.01)

(52) U.S. Cl.
CPC ..... *F01N 3/0253* (2013.01); *F01N 3/023* (2013.01)

(58) Field of Classification Search
CPC .. F01N 2550/04; F01N 2560/08; F01N 3/021; F01N 2900/1406; F01N 11/00; F01N 13/008
See application file for complete search history.

(56) References Cited

U.S. PATENT DOCUMENTS

| | | | | |
|---|---|---|---|---|
| 11,686,264 | B1 * | 6/2023 | Gwidt | F01N 9/002 60/303 |
| 12,359,636 | B2 * | 7/2025 | Toyama | F01N 3/023 |
| 2013/0086893 | A1 * | 4/2013 | Shinoda | F02B 47/08 60/278 |
| 2021/0156321 | A1 * | 5/2021 | Yao | F01N 3/2066 |
| 2023/0076483 | A1 | 3/2023 | Sugimoto | |
| 2024/0309825 | A1 * | 9/2024 | Toyama | F02D 41/029 |

FOREIGN PATENT DOCUMENTS

| | | | |
|---|---|---|---|
| JP | 2005-048709 | A | 2/2005 |
| JP | 2009221963 | A * | 10/2009 |
| JP | 2023-037344 | A | 3/2023 |

OTHER PUBLICATIONS

JP 2009221963 A English Machine Translation (Year: 2009).*

* cited by examiner

*Primary Examiner* — Anthony Ayala Delgado
(74) *Attorney, Agent, or Firm* — SoraIP, Inc.

(57) ABSTRACT

An internal combustion engine includes a filter configured to capture PM contained in exhaust gas flowing through an exhaust passage. A CPU of a control device executes a calculation process of calculating a PM deposition amount, namely an amount of PM captured in a filter, based on an operating condition of the internal combustion engine and an alcohol content rate of fuel that is supplied into a cylinder, and when the PM deposition amount exceeds a specified amount, executes a regeneration process of burning PM captured in the filter.

1 Claim, 3 Drawing Sheets

INTERNAL COMBUSTION ENGINE CONTROL DEVICE

CROSS-REFERENCE TO RELATED APPLICATION

This application claims priority to Japanese Patent Application No. 2024-170298 filed on Sep. 30, 2024. The disclosure of the above-identified application, including the specification, drawings, and claims, is incorporated by reference herein in its entirety.

BACKGROUND

1. Technical Field

The present disclosure relates to internal combustion engine control devices that are applied to internal combustion engines in which a filter is installed in an exhaust passage.

2. Description of Related Art

Japanese Unexamined Patent Application Publication No. 2023-37344 (JP 2023-37344 A) discloses a control device that is applied to an internal combustion engine in which a filter is installed in an exhaust passage. This control device executes a calculation process of calculating a PM deposition amount that is an amount of particulate matter (PM) captured in the filter. When the PM deposition amount exceeds a specified amount, this control device executes a regeneration process of burning the particulate matter captured in the filter.

In the calculation process, the control device calculates the PM deposition amount based on operating conditions including the intake air amount and the fuel injection amount of the internal combustion engine.

SUMMARY

When fuel containing alcohol is used as fuel for this internal combustion engine, the amount of particulate matter that is generated in the internal combustion engine varies depending on the alcohol content rate of the fuel. Therefore, when this control device is applied to an internal combustion engine that uses fuel containing alcohol, this control device may not be able to execute the regeneration process of the filter at an appropriate time, which may result in a decrease in fuel efficiency of the internal combustion engine.

An internal combustion engine control device according to a first aspect of the present disclosure is applied to

- an internal combustion engine including a cylinder, an exhaust passage through which exhaust gas discharged from the cylinder flows, and a filter configured to capture particulate matter contained in the exhaust gas flowing through the exhaust passage.

The internal combustion engine control device includes a processing circuit.

The processing circuit is configured to execute a calculation process of calculating a PM deposition amount based on an operating condition of the internal combustion engine and an alcohol content rate of fuel that is supplied into the cylinder. The PM deposition amount is an amount of the particulate matter captured in the filter.

The processing circuit is configured to, when the PM deposition amount exceeds a specified amount, execute a regeneration process of burning the particulate matter captured in the filter.

This internal combustion engine control device can reduce a decrease in fuel efficiency of the internal combustion engine by executing the regeneration process of the filter at an appropriate time.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

An embodiment of an internal combustion engine control device will be described with reference to FIGS. 1 to 4.

Figure 1:
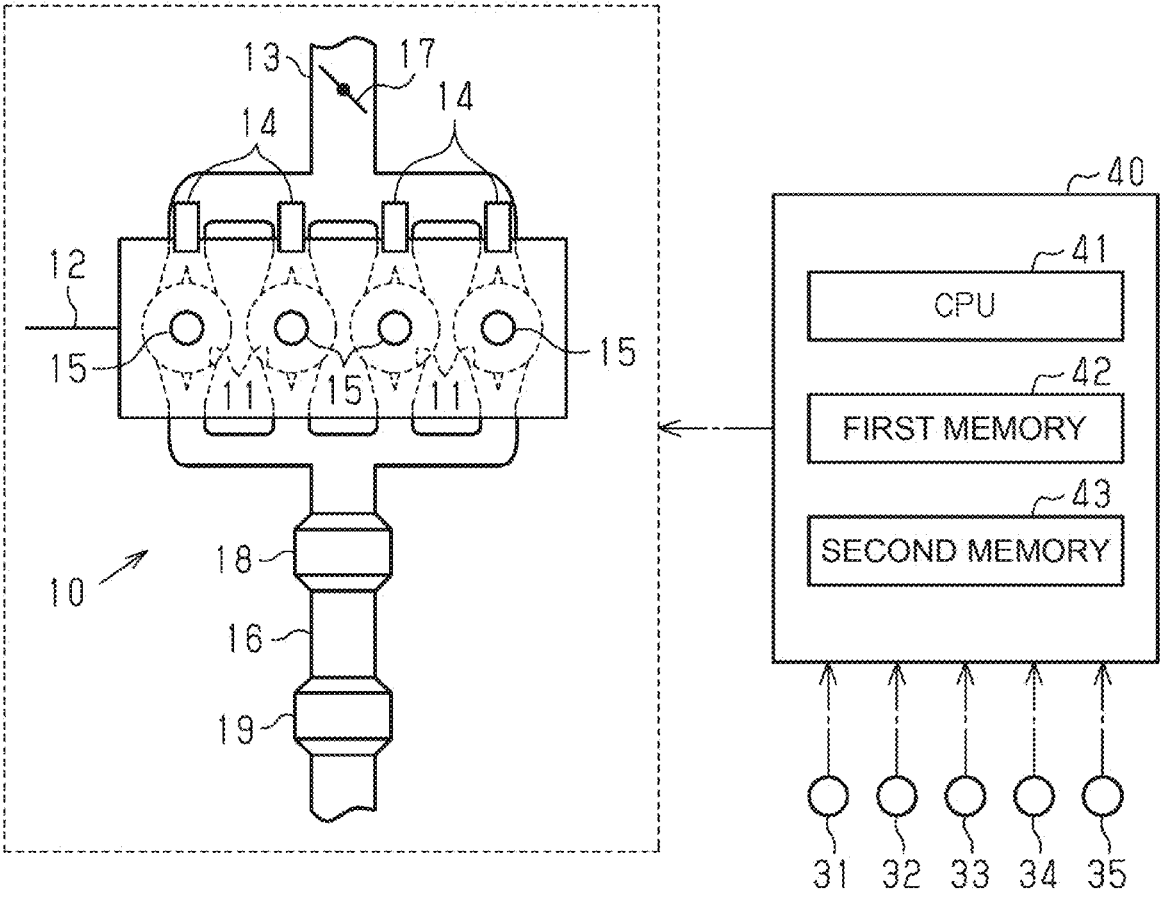
FIG. 1 is a configuration diagram illustrating an overview of a control device that is an embodiment of an internal combustion engine control device and an internal combustion engine to which the control device is applied.

FIG. 1 shows a control device 40 which is an example of an internal combustion engine control device, and an internal combustion engine 10 to which a control device 40 is applied. The internal combustion engine 10 is mounted on a vehicle.

Configuration of Internal Combustion Engine

The internal combustion engine 10 is an internal combustion engine that can be operated using fuel containing alcohol. The internal combustion engine 10 includes a plurality of cylinders 11, a crankshaft 12, an intake passage 13, a plurality of fuel injection valves 14, a plurality of spark plugs 15, and an exhaust passage 16. The intake passage 13 is a passage through which air to be introduced into the plurality of cylinders 11 flows. In the intake passage 13, a throttle valve 17 that operates to adjust the intake air amount is installed. Each fuel injection valve 14 injects the fuel supplied into a corresponding cylinder 11. In each of the cylinders 11, the air-fuel mixture containing air and fuel is combusted by the spark discharge of a corresponding spark plug 15. As a result, the crankshaft 12 rotates. The air-fuel mixture is burned, so that exhaust gas is generated in the plurality of cylinders 11. In the exhaust passage 16, the exhaust gas discharged from the plurality of cylinders 11 flows.

The internal combustion engine 10 includes a three-way catalyst 18 and a filter 19 installed in the exhaust passage 16. The three-way catalyst 18 is disposed in a portion of the exhaust passage 16 upstream of the filter 19. The three-way catalyst 18 reduces exhaust gas flowing through the exhaust passage 16. Specifically, the three-way catalyst 18 reduces hydrocarbons, carbon monoxide, and nitrogen oxides (NOx) in the exhaust gas. The filter 19 captures particulate matter contained in the exhaust gas flowing through the exhaust passage 16. Hereinafter, the particulate matter is referred to as "PM." "PM" stands for "particulate matter."

Sensors

The control device 40 receives detection signals from a plurality of sensors. The plurality of sensors includes a crank angle sensor 31, an air flow meter 32, an air-fuel ratio sensor 33, an exhaust gas temperature sensor 34, and an alcohol concentration sensor 35.

The crank angle sensor 31 detects a rotation angle of the crankshaft 12. The rotation speed of the crankshaft 12 based on the detection signal of the crank angle sensor 31 is referred to as an "engine rotation speed NE".

The air flow meter 32 detects a flow rate of air in the intake passage 13. The flow rate of the air based on the detected signal of the air flow meter 32 is referred to as "intake air volume GA".

The air-fuel ratio sensor 33 is disposed at a portion of the exhaust passage 16 upstream of the three-way catalyst 18. The air-fuel ratio sensor 33 detects the oxygen concentration of the exhaust gas flowing through the exhaust passage 16. That is, the air-fuel ratio sensor 33 can detect the air-fuel ratio of the air-fuel mixture. The air-fuel ratio of the exhaust gas based on the detection signal of the air-fuel ratio sensor 33 is referred to as "air-fuel ratio AF".

The exhaust gas temperature sensor 34 is disposed in the exhaust passage 16 at a portion between the three-way catalyst 18 and the filter 19. The exhaust gas temperature sensor 34 detects the temperature of the exhaust gas flowing into the filter 19. The temperature of the exhaust gas based on the detection signal of the exhaust gas temperature sensor 34 is referred to as "exhaust gas temperature TO".

The alcohol concentration sensor 35 detects the alcohol content rate of the fuel that is supplied into the plurality of cylinders 11. The alcohol content rate based on the detection result from the alcohol concentration sensor 35 is referred to as "alcohol content rate Ra."

Control Device

An example of the control device 40 is an electronic control device. The control device 40 includes a CPU 41, a first memory 42, and a second memory 43. The first memory 42 stores a control program to be executed by the CPU 41. The second memory 43 stores the calculation results from the CPU 41. In the present embodiment, the CPU 41 corresponds to the "processing circuit." When the CPU 41 executes the control program stored in the first memory 42, the CPU 41 can control the operation of the internal combustion engine 10.

The CPU 41 executes a calculation process of calculating a PM deposition amount Qdp that is an amount of PM captured in the filter 19, and when the PM deposition amount Qdp exceeds a specified amount Th, executes a regeneration process of burning PM captured in the filter 19.

Calculation Process

Figure 2:
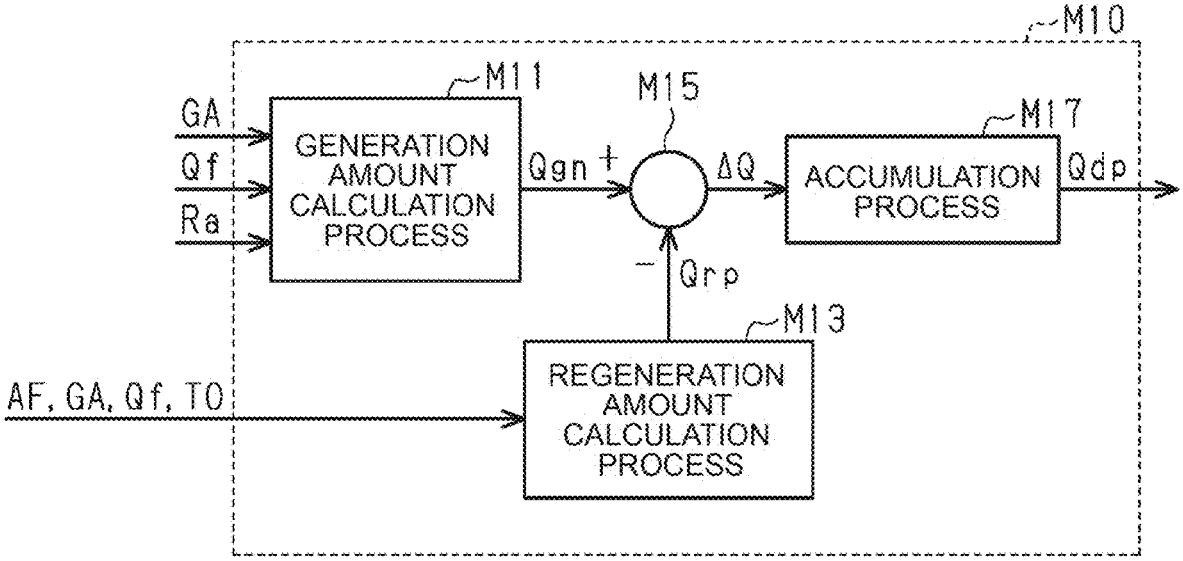
FIG. 2 is a block diagram illustrating a calculation process executed by the control device of FIG. 1.

An example of the calculation process will be described in detail with reference to FIGS. 2 and 3.

The calculation process M10 is a process of calculating the PM deposition amount Qdp based on the operating conditions of the internal combustion engine 10 and the alcohol content rate Ra. The calculation process M10 includes a generation amount calculation process M11, a regeneration amount calculation process M13, a difference calculation process M15, and an accumulation process M17.

The CPU 41 repeatedly executes the generation amount calculation process M11 at every predetermined calculation cycle. In the generation amount calculation process M11, the CPU 41 calculates a PM generation amount Qgn that is a sum of the amounts of PM generated in the plurality of cylinders 11 within a unit time. As used herein, the "unit time" is the length of time of the calculation cycle.

Figure 3:
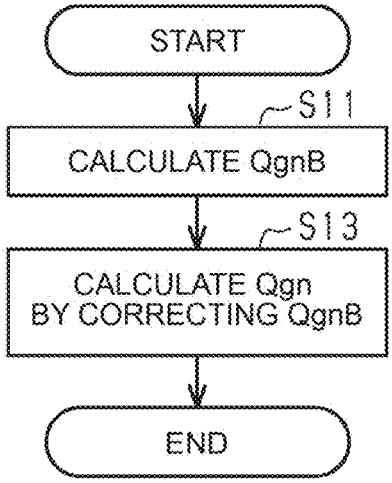
FIG. 3 is a flow chart showing the generation amount calculation process of FIG. 2.

As illustrated in FIG. 3, in the generation amount calculation process M11, the CPU 41 calculates the PM generation amount reference value QgnB that is a PM generation amount based on the operating conditions of the internal combustion engine 10 (S11). The PM generation amount reference value QgnB is a PM generation amount on the assumption that the fuel injected by the plurality of fuel injection valves 14 does not contain alcohol. The CPU 41 derives the PM generation amount reference value QgnB based on the intake air amount GA, the fuel injection amount Qf, etc.

Subsequently, the CPU 41 calculates the PM generation amount Qgn by correcting the PM generation amount reference value QgnB based on the alcohol content rate Ra (S13). For example, the CPU 41 calculates a product of the PM generation amount reference value QgnB and the correction factor $\alpha$ corresponding to the alcohol content rate Ra as PM generation amount Qgn.

The correction factor $\alpha$ is equal to or greater than 0 (zero) and equal to or less than one. The higher the alcohol content rate Ra, the less likely PM is to be generated. Therefore, the CPU 41 sets the correction factor $\alpha$ such that the higher the alcohol content rate Ra, the smaller the value. Thus, the CPU 41 can reduce the PM generation amount Qgn as the alcohol content rate Ra increases.

Returning to FIG. 2, the CPU 41 repeatedly executes the regeneration amount calculation process M13 at every calculation cycle described above. In the regeneration amount calculation process, the CPU 41 calculates a PM regeneration amount Qrp that is an amount of PM that is burned in the filter 19 within unit time.

The higher the temperature of the exhaust gas flowing into the filter 19, the higher the temperature of the filter 19. The higher the temperature of the filter 19, the more PM is burned in the filter 19. The more oxygen flows into the filter 19, the more PM is burned in the filter 19.

Therefore, in the regeneration amount calculation process M13, the CPU 41 derives the PM generation amount based on the temperature of the filter 19 and the amount of oxygen in the exhaust gas flowing into the filter 19. For example, the CPU 41 can estimate the temperature of the filter 19 based on the exhaust gas temperature TO, the flow rate of the exhaust gas flowing into the filter 19, and the outside air temperature. The CPU 41 can estimate the amount of oxygen in the exhaust gas flowing into the filter 19, based on the air-fuel ratio AF, the intake air amount GA, and the fuel injection amount Qf.

The CPU 41 repeatedly executes the difference calculation process M15 at every calculation cycle described above. In the difference calculation process M15, the CPU 41 calculates, as a difference $\Delta Q$, a value obtained by subtracting the PM regeneration amount Qrp from the PM generation amount Qgn.

The CPU 41 executes the accumulation process M17 every time the difference $\Delta Q$ is calculated by the difference calculation process M15. In the accumulation process M17, the CPU 41 calculates the sum of the previous value of the PM deposition amount Qdp and the difference $\Delta Q$ as the most recent value of the PM deposition amount Qdp. That is, the CPU 41 calculates a cumulative value of the differences $\Delta Q$ as the PM deposition amount Qdp.

Regeneration Process

Figure 4:
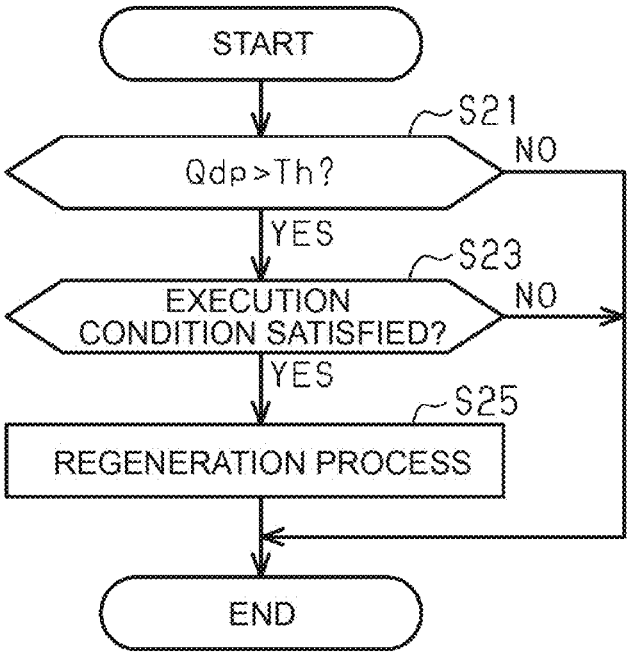
FIG. 4 is a flowchart illustrating a series of steps when the regeneration process is executed in the control device of FIG. 1.

The timing to execute the regeneration process and the content of the regeneration process will be described with reference to FIG. 4. The CPU 41 repeatedly executes a series of steps illustrated in FIG. 4.

In S21, the CPU 41 determines whether the PM deposition amount Qdp calculated in the calculation process M10 is larger than the specified amount Th. The specified amount Th is a criterion for determining whether the filter 19 should be regenerated. When the PM deposition amount Qdp is greater than the specified amount Th (S21: YES), the CPU 41 transitions the process to S23. On the other hand, when the PM deposition amount Qdp is equal to or less than the specified amount Th (S21: NO), the CPU 41 ends the series of steps illustrated in FIG. 4.

In S23, the CPU 41 determines whether an execution condition for the regeneration process is satisfied. As will be described in detail later, combustion of the air-fuel mixture in the cylinders 11 is stopped in the regeneration process. Therefore, when the crankshaft 12 can be rotated by the power from outside the internal combustion engine 10, it can be considered that the execution condition is satisfied. For example, when the vehicle travels inertially, the crankshaft 12 is rotated by power transmission from the wheels. For example, when the vehicle is a hybrid electric vehicle in which an electric motor is connected to the crankshaft 12, the crankshaft 12 can be rotated by driving the electric motor.

In S23, when the CPU 41 determines that the execution condition is satisfied (S23: YES), the CPU 41 proceeds the process to S25. On the other hand, when the CPU 41 determines that the execution condition is not satisfied (S23: NO), the CPU 41 ends the series of steps illustrated in FIG. 4.

In S25, the CPU 41 executes the regeneration process. In the regeneration process, the CPU 41 stops spark discharge of the spark plugs 15 and causes the fuel injection valves 14 to perform fuel injection, thereby raising the temperature of the filter 19 to a PM ignition point or higher.

When the spark discharge of the spark plugs 15 is stopped, the unburned fuel injected from the fuel injection valves 14 flows out of the cylinders 11 into the exhaust passage 16. Such unburned fuel is supplied together with air to the three-way catalyst 18. As a result, the three-way catalyst 18 burns unburned fuel, and thus the temperature of the three-way catalyst 18 increases. At this time, since the crankshaft 12 is rotating, the heat of the three-way catalyst 18 is transferred to the filter 19 by the flow of the gas passing through the three-way catalyst 18 and toward the filter 19. As a result, when the temperature of the filter 19 becomes higher than the PM ignition point, the PM is burned in the filter 19.

The CPU 41 ends the regeneration process when the execution time of the regeneration process reaches a predetermined time. Then, the CPU 41 ends the series of steps illustrated in FIG. 4.

When the CPU 41 executes the regeneration process as described above, for example, the CPU 41 resets the PM deposition amount Qdp to a predetermined value. An example of the predetermined value is 0 (zero).

Functions and Effects of Embodiment (1) The rate of increase in the amount of PM adhering to the filter 19 varies depending on the alcohol content rate Ra of the fuel supplied to the cylinders 11.

Therefore, the CPU 41 calculates the PM deposition amount Qdp by considering the alcohol content rate Ra in addition to the operating conditions of the internal combustion engine 10. Thus, even when the internal combustion engine 10 is operated using the alcohol containing fuel, the CPU 41 can accurately estimate the PM deposition amount in the filter 19.

The CPU 41 executes the regeneration process when the PM deposition amount Qdp calculated as described above exceeds the specified amount Th. Therefore, the CPU 41 can reduce a decrease in fuel efficiency of the internal combustion engine 10 by executing the regeneration process at an appropriate time.

(2) The CPU 41 calculates the PM deposition amount Qdp by accumulating the differences ΔQ between the PM generation amount Qgn and the PM regeneration amount Qrp.

The PM generation amount in each cylinder 11 varies depending on the alcohol content rate Ra of the fuel, while the PM burning rate in the filter 19 is less dependent on the alcohol content rate Ra.

Therefore, the CPU 41 calculates the PM generation amount Qgn by correcting, based on the alcohol content rate Ra, the PM generation amount reference value QgnB calculated based on the operating conditions of the internal combustion engine 10. The CPU 41 then calculates the PM deposition amount Qdp by accumulating the differences ΔQ between the PM generation amount Qgn and the PM regeneration amount Qrp. Therefore, the CPU 41 can accurately estimate the PM deposition amount in the filter 19.

Modifications

The above embodiment can be modified as follows. The above embodiment and the following modifications can be implemented in any combination as long as no technical contradiction occurs.

- The CPU 41 may calculate the PM generation amount Qgn without considering the alcohol content rate Ra, as long as the operating conditions of the internal combustion engine 10 are considered. In this case, the CPU 41 may correct the difference ΔQ between the PM generation amount Qgn and the PM regeneration amount Qrp based on the alcohol content rate Ra. In this case, the CPU 41 calculates the PM deposition amount Qdp by accumulating the corrected differences ΔQ.
- The regeneration process may be a process different from the process described in the above embodiment as long as the temperature of the filter 19 can be increased. For example, the regeneration process may include at least one of the following controls: dither control for each cylinder 11, fuel cut control on part of the cylinders 11, and control for retarding the ignition timing.
- The CPU 41 may estimate the alcohol content rate using the air-fuel ratio AF etc. The CPU 41 may then calculate the PM deposition amount Qdp using the estimated value of the alcohol content rate.
- The internal combustion engine to which the control device 40 is applied may be any internal combustion engine as long as it has one or more cylinders 11.
- The control device 40 includes a CPU and a ROM, and is not limited to a device that executes software processing. That is, the control device 40 may have any of the following configurations (a), (b), and (c).

(a) The control device 40 includes one or more processors that execute various processes in accordance with a computer program. The processor includes a CPU and a memory such as a RAM and a ROM. The memory stores program codes or commands configured to cause the CPU to execute a process. The memory, that is, a computer-readable medium, includes any available medium that can be accessed by a general purpose or special purpose computer.

(b) The control device 40 includes one or more dedicated hardware circuits for executing various processes. The dedicated hardware circuits may include, for example, an application-specific integrated circuit, i.e., ASIC, or an FPGA. ASIC stands for "Application-Specific Integrated Circuit," and FPGA stands for "Field-Programmable Gate Array."

(c) The control device 40 includes one or more processors that execute part of various processes in accordance with a computer program, and one or more hardware circuits dedicated to executing the rest of the various processes.

It should be noted that the expression "at least one" as used herein means "one or more" of desired options. As an example, when there are two options, the expression "at least one" as used herein means "one option" or "both of the two options." As another example, when there are three or more options, the expression "at least one" as used herein means "one option" or "any combination of two or more options."

What is claimed is:

1. An internal combustion engine control device that is applied to an internal combustion engine including a cylinder, an exhaust passage through which exhaust gas discharged from the cylinder flows, and a filter configured to capture particulate matter contained in the exhaust gas flowing through the exhaust passage, the internal combustion engine control device comprising a processing circuit, wherein:

the processing circuit is configured calculate a PM deposition amount based on an operating condition of the internal combustion engine and an alcohol concentration of fuel that is supplied into the cylinder, the PM deposition amount being an amount of the particulate matter captured in the filter, wherein the processing circuit calculates the PM deposition amount by calculating a difference between a PM generation amount and a PM regeneration amount based on the operating condition of the internal combustion engine and the alcohol concentration of the fuel at predetermined intervals, the PM generation amount being an amount of the particulate matter that is generated in the cylinder, the PM regeneration amount being an amount of the particulate matter that is burned in the filter, and calculates a cumulative value of the difference as the PM deposition amount, and wherein, when the processing circuit calculates the PM generation amount, the processing circuit calculates the PM generation amount in such a manner that a value of the PM generation amount decreases as the alcohol concentration of the fuel increases; and the processing circuit is configured to, when the PM deposition amount exceeds a specified amount, execute a regeneration process of burning the particulate matter captured in the filter.

* * * * *